US007284346B2

(12) United States Patent
Miskin

(10) Patent No.: US 7,284,346 B2
(45) Date of Patent: Oct. 23, 2007

(54) SYSTEMS AND METHODS FOR CONTROLLING THE REMOVAL OF SOIL FROM AN EARTH MOVING SCRAPER

(76) Inventor: Mark R. Miskin, 225 Targhee Tower Rd., Alta, WY (US) 83414

( * ) Notice: Subject to any disclaimer, the term of this patent is extended or adjusted under 35 U.S.C. 154(b) by 0 days.

(21) Appl. No.: 10/666,237

(22) Filed: Sep. 18, 2003

(65) Prior Publication Data

US 2005/0072581 A1 Apr. 7, 2005

(51) Int. Cl.
*E02F 1/00* (2006.01)
*E02F 3/64* (2006.01)
*G05D 1/00* (2006.01)

(52) U.S. Cl. ..... 37/416; 37/195

(58) Field of Classification Search ..... 37/414–416, 37/195; 172/197, 199, 200
See application file for complete search history.

(56) References Cited

U.S. PATENT DOCUMENTS 3,633,461 A 1/1972 Take et al.
3,651,589 A * 3/1972 Reynolds ..... 37/414
3,934,360 A 1/1976 Hyler
4,009,530 A 3/1977 Eftefield
4,024,798 A 5/1977 Schexnayder et al.
4,055,222 A 10/1977 Runte
4,217,962 A 8/1980 Schaefer
4,269,535 A 5/1981 Schultz
4,308,677 A 1/1982 Behm
4,366,635 A 1/1983 Joyce, Jr.
4,383,380 A 5/1983 Miskin
4,388,769 A 6/1983 Miskin
4,398,363 A 8/1983 Miskin
4,402,368 A 9/1983 Moberly
4,553,608 A 11/1985 Miskin
4,679,336 A 7/1987 Brocklebank et al.
4,715,012 A 12/1987 Mueller, Jr.
4,773,814 A 9/1988 Brocklebank et al.
5,097,857 A 3/1992 Mayhew
5,295,795 A 3/1994 Yasuda et al.
5,776,422 A 7/1998 Kawasaki
5,794,714 A 8/1998 Brown
5,992,590 A 11/1999 Harries
6,041,528 A 3/2000 Broach
6,092,316 A 7/2000 Brinker
6,125,561 A 10/2000 Shull
6,276,077 B1 8/2001 Kirbie
6,301,808 B1 10/2001 Hodge
6,336,068 B1 1/2002 Lawson et al.
6,347,670 B1 2/2002 Miskin
6,352,126 B1 3/2002 Brown

* cited by examiner

OTHER PUBLICATIONS

Miskin Construction Scraper Advertising Brochure, 2002.

*Primary Examiner*—Christopher J. Novosad
(74) *Attorney, Agent, or Firm*—Morriss O'Bryant Compagni

(57) ABSTRACT

Hydraulic systems for controlling movement of an apron and a bucket of earth moving apparatuses are disclosed. The hydraulic system includes a hydraulic fluid supply, a hydraulic cylinder for moving the apron, a hydraulic cylinder for moving the bucket and a valve for controlling flow of hydraulic fluid to the hydraulic cylinders. The hydraulic system includes another valve for controlling the flow of hydraulic fluid to the hydraulic cylinders. An earth moving apparatus having a bucket and an apron configured with the hydraulic system is also disclosed. Methods for controlling movement of the bucket and the apron are also disclosed. An earth moving apparatus having an ejector wall for removing soil from the bucket is described. A linkage structure for reducing the force required to move the ejector wall is incorporated in the earth moving apparatus. A substantially, vertical oriented hydraulic cylinder for moving the ejector wall is also described.

13 Claims, 12 Drawing Sheets

SYSTEMS AND METHODS FOR CONTROLLING THE REMOVAL OF SOIL FROM AN EARTH MOVING SCRAPER

TECHNICAL FIELD

The present invention relates generally to an apparatus for modifying the earth's surface by removing soil from the earth's surface at one location and moving the soil to a new location. More specifically, the present invention relates to an earth moving apparatus including a bucket that receives soil removed from the earth and systems and methods for controlling removal of the soil from the bucket.

BACKGROUND

Scrapers and other earth moving apparatuses of the general type to which the present invention relates are known. Representative examples of earth moving scrapers include, without limitation, the scrapers disclosed in U.S. Pat. No. 4,383,380, U.S. Pat. Nos. 4,388,769, 4,398,363, 4,553,608 and U.S. Pat. No. 6,347,670 to Miskin, the disclosures of which are each incorporated herein by reference. A typical scraper includes a frame having a front end, two opposing sides and at least two wheels connected to the opposing sides. A bucket for holding earth is connected to the frame. The bucket includes a floor, a rear wall, two upstanding opposing side walls, an open front and an open top. An apron, or gate, is located opposite the rear wall of the bucket and can swing closed to hold the soil in the bucket during transport. A blade is located adjacent the front edge of the floor of the bucket and cuts the earth to a predetermined depth as the earth moving apparatus is moved forward over the earth's surface. The soil cut from the earth by the blade is collected in the bucket. When the bucket is full of soil, the scraper is transported to another location where the soil is deposited.

The scraper or earth moving apparatus typically has an elongated tongue attached to the frame. The tongue is connected to a tractor that tows the scraper or the earth moving apparatus. The tongue may be connected to a tractor with a hitch or the tongue may be a so-called rigid, gooseneck that pivots and is attached to the tractor. Alternatively, the scraper may include a front set of "dolly" wheels or may be attached to a separate dolly that attaches to a tractor. Other scrapers or other earth moving apparatuses are self-propelled.

The soil is removed from the bucket in different ways. For instance, moving back scrapers, sweep scrapers, open bottom scrapers and dump scrapers are known. An ejector scraper has a moving wall or ejection assembly that pushes the soil out of the bucket. An example of an ejector scraper is disclosed in U.S. Pat. No. 6,041,528 assigned to Harvey Mfg. Corp. An example of a sweep scraper is an elevating type scraper that discharges soil collected in the bucket by moving members, or slats, across the floor of the bucket. An exemplary sweep scraper is disclosed in U.S. Pat. No. 3,934,360 assigned to Westinghouse Air Brake Company. In a dump scraper, the bucket of the scraper is tilted to dump the soil out of an open end of the bucket. Examples of pull-type bottom scrapers include scrapers disclosed in U.S. Pat. No. 4,383,380, U.S. Pat. Nos. 4,388,769, 4,398,363, 4,553,608 and U.S. Pat. No. 6,347,670 to Miskin.

However, for various reasons, the operator of the earth moving apparatus may need to more precisely control the unloading of the soil from the bucket or the time required to remove the soil from the bucket. For instance, loose soils, such as sandy soils, granular soils or dry soils, may readily flow out of the bucket when the bucket is tilted and the user may want to control the flow of the soil out of the bucket. In other instances, when the bucket is raised in a dump scraper, the soil may clump together and remain in the bucket until a large amount of the soil rushes out of the bucket all at once, thus hindering the ability of the user to control rate at which the soil exits from the bucket. In ejector scrapers, the time required for the ejector assembly to push the soil out of the bucket varies based on the power of the hydraulic system in tractors without high flow hydraulics.

Thus, a need exists for an improved earth moving apparatus that allows an operator to control the removal of the soil from the bucket.

SUMMARY OF THE INVENTION

A hydraulic system for controlling movement of an apron and a bucket of an earth moving apparatus is disclosed. The hydraulic system includes a hydraulic fluid supply means, a first hydraulic propulsion means for moving the apron, a second hydraulic propulsion means for moving the bucket and a first control means for controlling the flow of hydraulic fluid from the hydraulic fluid supply means to the first and second propulsion means. The hydraulic system also includes a second control means for selectively controlling the flow of hydraulic fluid to the first propulsion means or the second propulsion means to restrict movement of the apron or the bucket upon activation of the second control means.

An earth moving or ground leveling apparatus is also disclosed. The earth moving and ground leveling apparatus includes a frame having opposing sides that is supported by at least two ground engaging wheels. The earth moving or ground leveling apparatus may also includes a bucket having a floor, a pair of side walls, a rear wall and an apron for holding soil in the bucket. The earth moving or ground leveling apparatus further includes a hydraulic system for imparting movement to the bucket and the apron in such a manner that the apron can be opened or closed and the bucket can be lowered for scraping soil; raised for transporting soil, and one end lifted for expelling soil. The hydraulic system includes a first valve for controlling movement of the bucket and the apron and a second valve for preventing movement of the bucket or the apron such that movement of the bucket and the apron may be effectuated independently.

A method for moving soil with an earth moving apparatus is further disclosed. The method includes providing an earth moving apparatus having a bucket for storing soil and an apron for holding the soil in the bucket. The method also includes providing a hydraulic system having a first hydraulic cylinder for moving the bucket, a second cylinder for moving the apron and a first valve for controlling movement of the bucket and the apron. The method further includes activating the hydraulic system to initiate movement of the bucket and the apron and impeding the movement of the bucket or the apron with a second valve.

An earth moving or ground leveling apparatus having a frame with opposing sides and at least two ground engaging wheels supporting the frame is also disclosed. The earth moving or ground leveling apparatus includes a bucket having a floor and a pair of sidewalls, and a movable wall located adjacent to the pair of the sidewalls. A propulsion means imparts movement to the movable wall and a lever means transfers force from the propulsion means to the movable wall.

In another embodiment, an earth moving or ground leveling apparatus having a substantially vertical, hydraulic cylinder that imparts movement to a movable wall is described. The earth moving or ground leveling apparatus includes a frame having opposing sides, at least two ground engaging wheels supporting the frame and a bucket having a floor and a pair of side walls. A linkage means transfers a force generated by the substantially vertical, hydraulic cylinder into a perpendicular force that imparts movement to the movable wall.

BRIEF DESCRIPTION OF THE DRAWINGS

It will be appreciated by those of ordinary skill in the art that the elements depicted in the various drawings are not drawn to scale, but are for illustrative purposes only. The nature of the present invention, as well as other embodiments of the present invention, may be more clearly understood by reference to the following detailed description of the invention, to the appended claims and to the several drawings, wherein:

DETAILED DESCRIPTION

The present invention relates generally to an apparatus for modifying the earth's surface by removing soil from the earth's surface at one location and moving the soil to another location. More specifically, the apparatus relates to earth moving scrapers that have a frame carried by at least two wheels, a cutting blade connected to the frame, a bucket mounted to the frame and located adjacent to the blade such that the bucket receives soil cut the blade and to systems and methods for controlling the amount of soil exiting the bucket.

It will be apparent to those of ordinary skill in the art that the embodiments described herein, while illustrative, are not intended to so limit the invention or scope of the appended claims. Those of ordinary skill will understand that various combinations or modifications of the embodiments presented herein may be made without departing from the scope of the present invention.

Figure 1:
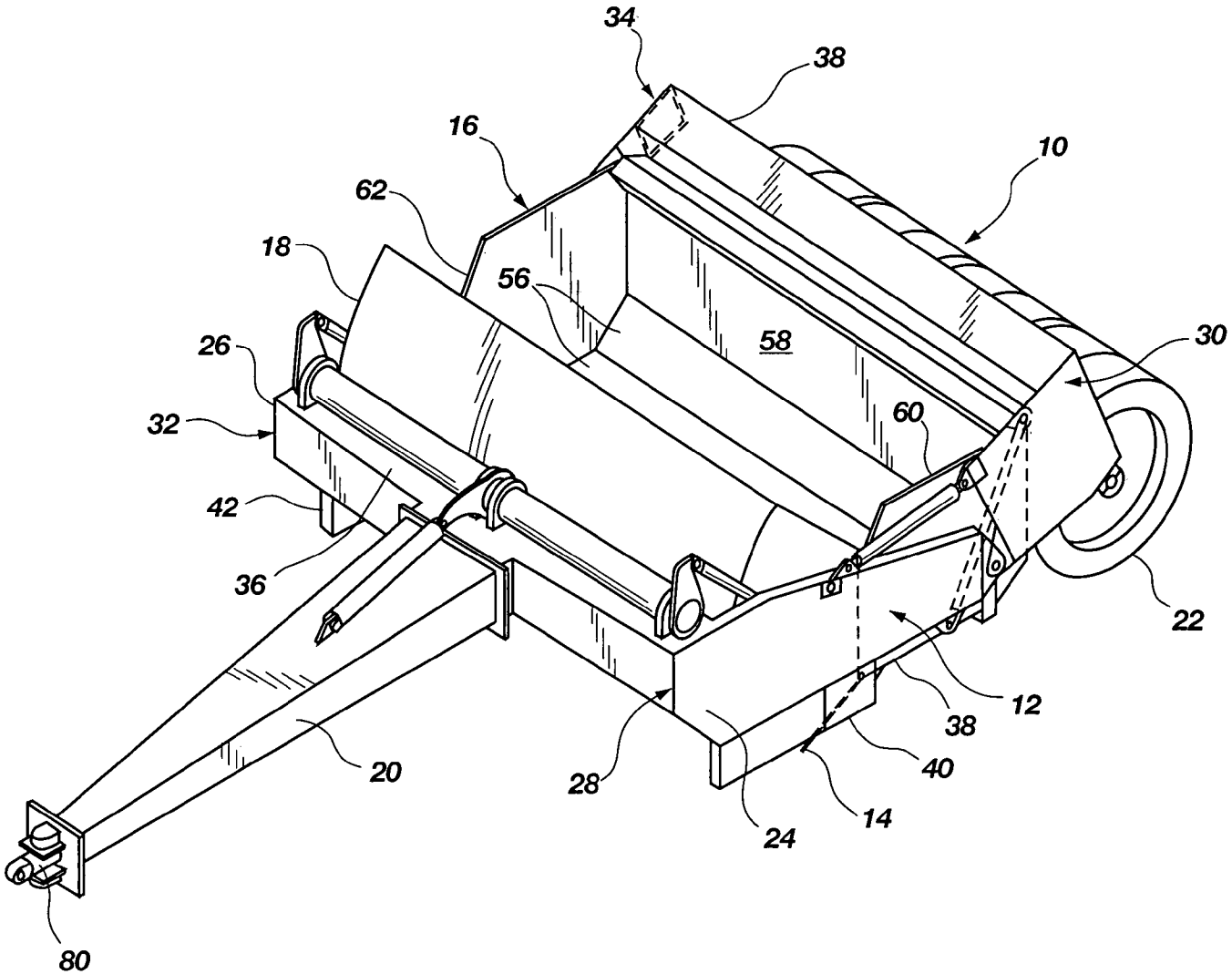
FIG. 1 is a perspective view of an earth moving apparatus of the present invention.

Referring now to drawing FIG. 1, there is shown, generally at 10, a perspective view of an earth moving apparatus that includes an exemplary system for controlling the loading and unloading of the bucket. Representative examples of earth moving apparatuses which may be used in the conjunction with the exemplary systems for controlling the loading and unloading of the bucket include, without limitation, U.S. Pat. Nos. 4,383,380, 4,388,769, 4,398,363, 4,553,608 and U.S. Pat. No. 6,347,670, and U.S. patent application Ser. No. 10/427,471 (the contents of the entirety of which are incorporated herein by reference) to Miskin. It will apparent that the system for controlling the loading and unloading of the bucket may be operatively connected to any pull-type scraper, self-propelled scraper, moving back scraper including a moving wall or ejector assembly in the bucket that pushes the soil out of the bucket, sweep scraper including at least one moving section of the floor of the bucket that transfers the soil out of the bucket, open bottom scraper or dump scraper including a bucket configured to tilt and dump the soil out of the bucket, in addition to the scrapers disclosed in the Miskin patents.

As illustrated in drawing FIG. 1, the earth moving apparatus 10 includes a frame 12, a cutting blade 14, a bucket 16, an apron 18, a tongue 20 and at least two ground engaging wheels 22. The frame 12 includes first and second opposing side members 24 and 26, respectively. The first side member 24 has a first end 28 and a second end 30 and the second side member 26 has a first end 32 and a second end 34. The first end 28 of the side member 24 and the first end 32 of the side member 26 are joined together by a front member 36. The second ends 30 and 34 of the side members 24 and 26, respectively, are attached to a carrier shown, generally, at 38.

As shown, the cutting blade 14 is attached to the frame 12 and is disposed generally laterally between the opposing side members 24 and 26 of the frame 12. The cutting blade 14 may be adjoined to a bottom 39 of side member 24 and a bottom (not shown) of side member 26. The blade 14 may be attached to a portion 40 of the frame 12 that extends downwardly from the side member 26 and a portion 42 of the frame 12 on the opposite side. In other embodiments, the blade 14 may be attached to the bucket 16 and it will be apparent that the blade 14 may be adjoined to the earth moving apparatus 10 in any manner known by those of ordinary skill in the art. The bucket 16 includes a floor 56, an upstanding back wall 58 and upstanding side walls 60 and 62, as shown in drawing FIG. 1. A forward edge 64 of the floor 56 of the bucket 16, as seen in drawing FIG. 4, adjoins a trailing edge 66 of the blade 14. The blade 14 may be fixedly attached to the frame 12 such that the bucket 16 pivots on a hinge 68. In other embodiments, the bucket 16 may be pivotally mounted to the frame 12 and the blade 14 fixedly attached to the bucket 16.

Figure 2:
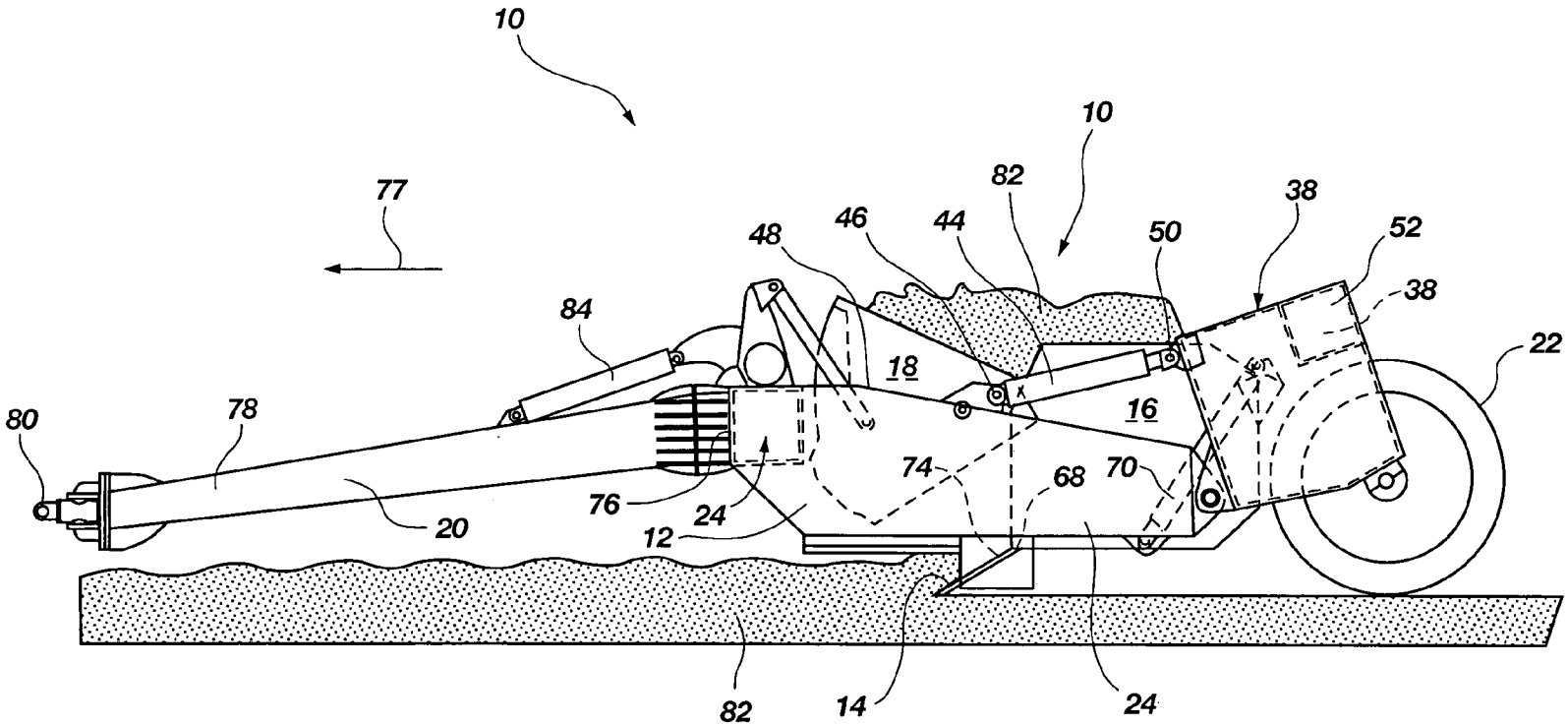
FIG. 2 is a side view of the earth moving apparatus of FIG. 1 in a scraping position.
Figure 3:
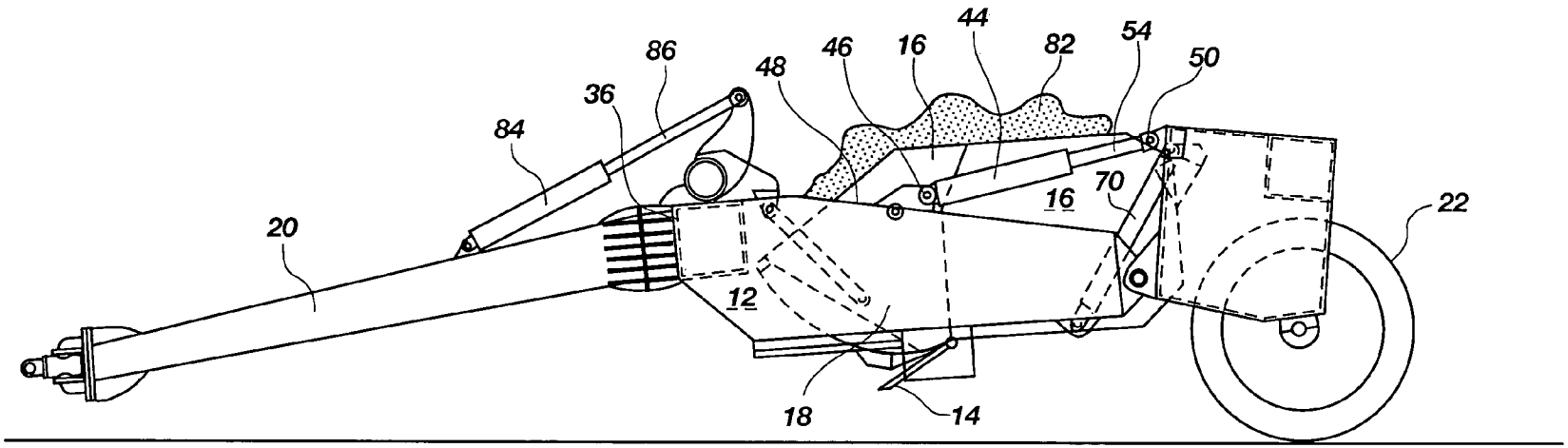
FIG. 3 is a side view of the earth moving apparatus of FIG. 1 in a transport position.
Figure 4:
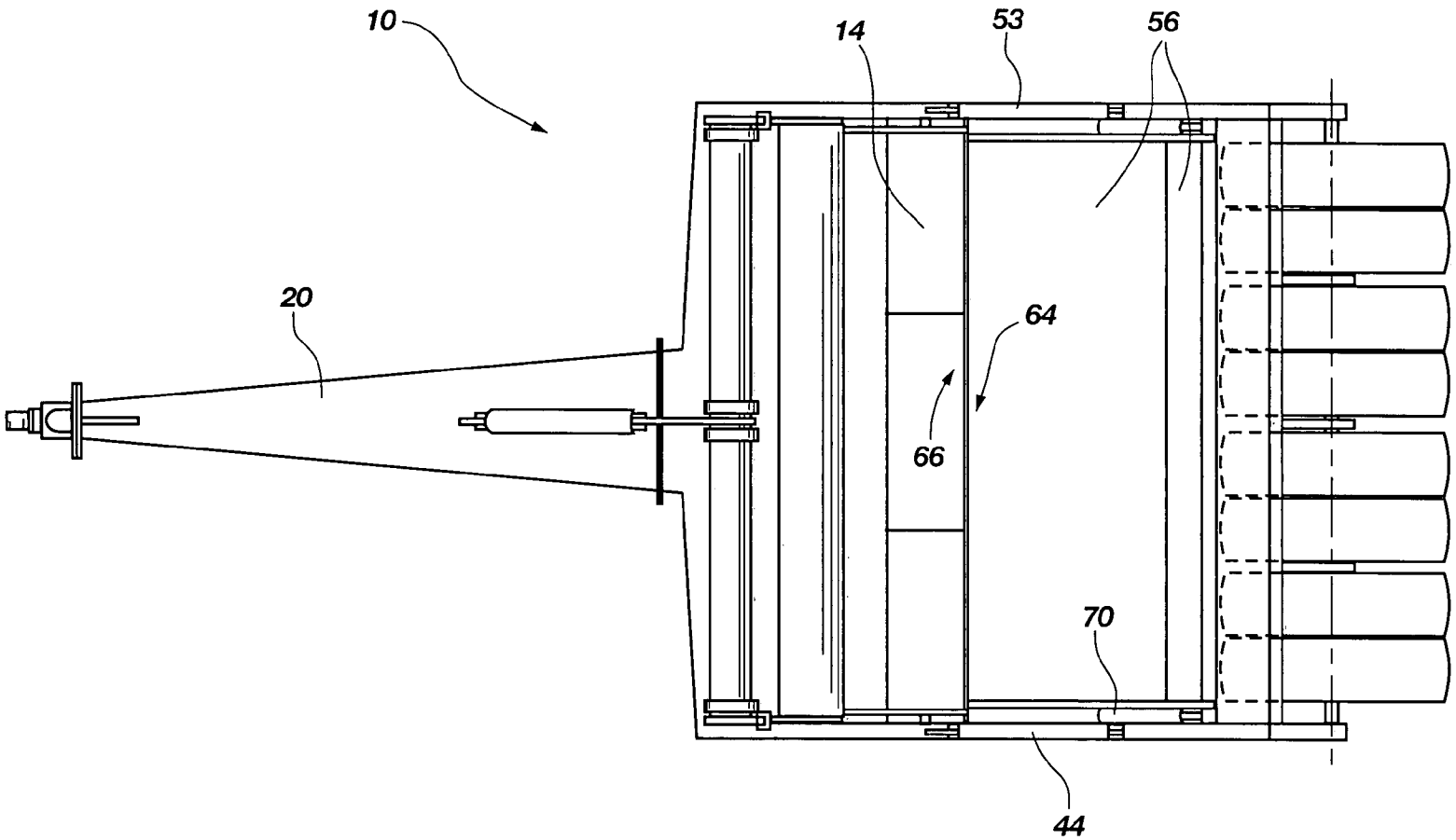
FIG. 4 is a top view of the earth moving apparatus of FIG. 1.

Referring now to drawing FIG. 2, there is shown a side view of the earth moving apparatus 10 of drawing FIG. 1 in a scraping position. An actuator, such as a first double-acting hydraulic cylinder 44 has a first end 46 attached to a top edge 48 of the first side member 24 and a second end 50 pivotally attached to an arm 52 of the carrier 38. As known in the art, a double-acting hydraulic cylinder is able to exert force in two directions. When a piston rod 54 of the double-acting cylinder 44 is extended, as seen in drawing FIG. 3, the bucket 16 is effectively raised as the earth moving apparatus 10 changes from the scraping position of drawing FIG. 2 to a transport position of drawing FIG. 3. The attachments and operation of second double-acting hydraulic cylinder 53 on the opposite side of the first double-acting hydraulic cylinder 44, as illustrated in a top view of the earth moving apparatus 10 of drawing FIG. 4, is in substantially the same manner as the first double-acting hydraulic cylinder 44 described herein.

Figure 5:
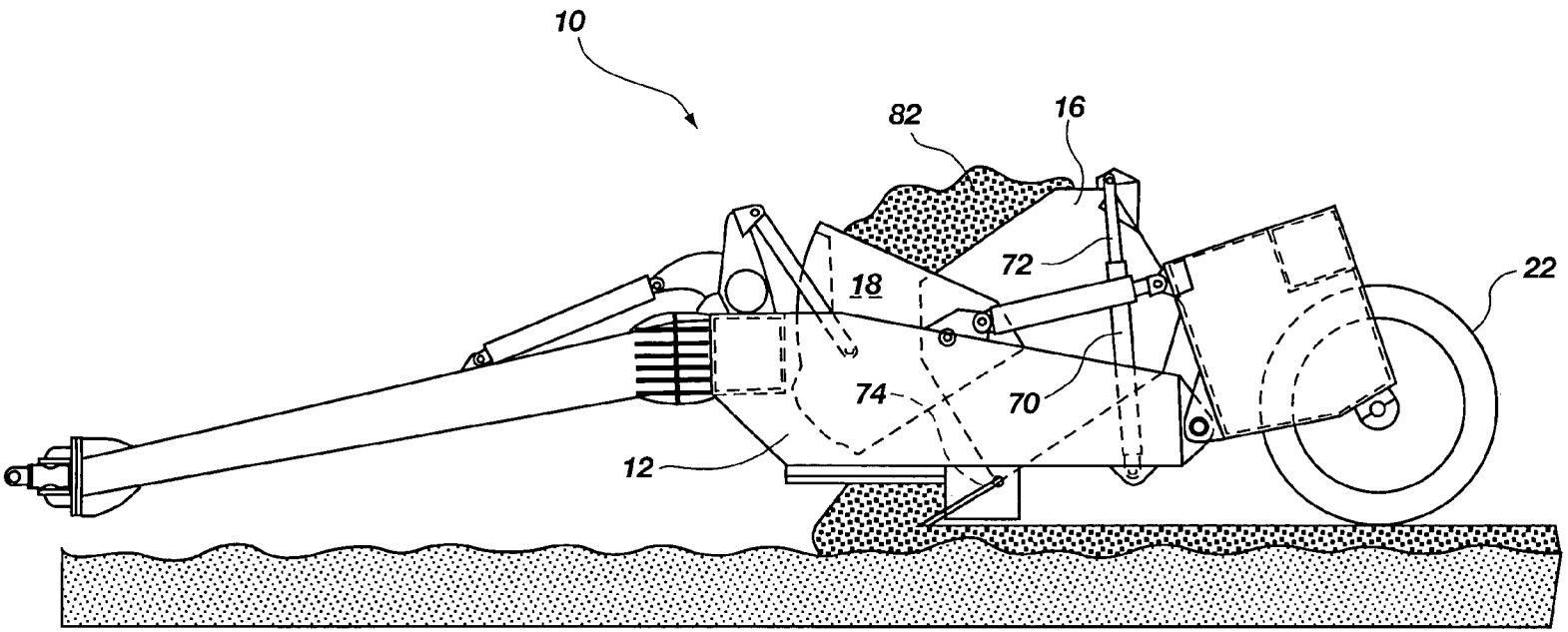
FIG. 5 is a side view of the earth moving apparatus of FIG. 1 in a dumping position.

Referring to drawing FIG. 5, there is shown the earth moving scraper 10 in a dumping position. A double-acting bucket hydraulic cylinder 70 has one end mounted to the frame 12 and the other end mounted to the bucket 16. Upon extending a piston rod 72 of the double-acting bucket hydraulic cylinder 70, the bucket 16 is raised and rotates about a hinge 74. In another exemplary embodiment, the double-acting bucket hydraulic cylinder may be a single acting hydraulic cylinder, which as known in the art, exerts force in one direction wherein the weight of the bucket 16 could reverse movement of the single acting hydraulic cylinder.

As known in the art, the earth moving apparatus 10 is used for scraping soil from one location and moving the soil to another location. To accomplish these tasks, the earth moving apparatus 10 is operatively connected to a tractor (not shown) and pulled. FIGS. 2, 3 and 5 illustrate, generally, the relative position of the components of the earth moving apparatus 10 in performing these tasks. As illustrated in FIG. 2, the tongue 20 of the earth moving apparatus 10 has a first end 76 that is attached to the frame 12 and a second end 78 that extends outwardly therefrom. A portion of the second end 78 comprises an attaching means, such as a hitch 80, which is configured for attachment to the tractor (not shown) for pulling the earth moving apparatus 10.

In FIG. 2, the earth moving apparatus is in a scraping position wherein the blade 14 is positioned to cut soil 82. As the earth moving apparatus 10 moves forward in the direction indicated by arrow 77, the soil 82 is cut and travels across the blade 14 and into the bucket 16. In the scraping position, the apron 18 is raised to a level such the soil 82 is able to travel into the bucket 16. Once the bucket 16 becomes loaded with soil 82, or at any other instance as decided by an operator of the earth moving apparatus 10, the earth moving apparatus 10 is raised to a transport position as illustrated in FIG. 3 by extending the rod 54 of the first double-acting hydraulic cylinder 44 using a hydraulic system (FIGS. 6-8) operatively connected to the tractor, and the opposing, second double-acting cylinder 53, to effectively raise the bucket 16. In the transport position the apron 18, illustrated with phantom lines in FIG. 3, is lowered to prevent the soil 82 from falling out of the front of the bucket 16 by extending a rod 86 of an apron hydraulic cylinder 84 using the hydraulic system.

Once the earth moving apparatus 10 has been transported to the location where the operator desires to unload the soil 82 from the bucket 16, the earth moving apparatus 10 is placed in the dump position as illustrated in FIG. 5. To initiate the dump sequence, the apron 18 is raised by retracting the rod 86 of the apron hydraulic cylinder 84 using the hydraulic system. It will be appreciated that while the raising of apron 18 in the depicted embodiment of an earth moving apparatus 10 is accomplished by the extension of a rod, the same function may be accomplished in other embodiments by retraction of a rod and is within the scope of the present invention. Once the apron 18 is fully in the raised position, a sequence valve of the hydraulic system (shown in drawing FIG. 6) causes a rod 72 of the bucket hydraulic cylinder 70 to extend, thus, lifting the portion of the bucket 16 located nearest the wheels 22. Once the bucket 16 is raised, the soil 82 is dumped out of the bucket 16 as illustrated. The soil 82 is dumped from the bucket 16 in a controlled manner to level the uneven surface of the earth. By controlling the raising and lowering of the bucket 16 in this manner, the operator is able to control the flow of the soil 82 exiting the bucket 16.

It will be apparent by those of ordinary skill in the art that the various hydraulic cylinders of the earth moving apparatus 10 of the present invention are fitted with hydraulic lines (not shown) that are operatively connected to a hydraulic fluid supply (FIG. 6) as is known in the art. In the illustrated embodiment the hydraulic fluid comprises hydraulic oil, but it will apparent to those of ordinary skill in the art that any known fluid used in hydraulic systems may be used and not depart from the spirit of the present invention. The hydraulic oil supply may be associated with the tractor (not shown) used to pull the earth moving apparatus 10 as is known in the art. The operator of the earth moving apparatus 10 operates the various hydraulic cylinders of the earth moving apparatus 10 using levers that control the hydraulic system of the tractor. In alternative embodiments, the earth moving apparatus may be a self-propelled type earth moving apparatus wherein the hydraulic oil supply is associated with the earth moving apparatus.

Figure 6:
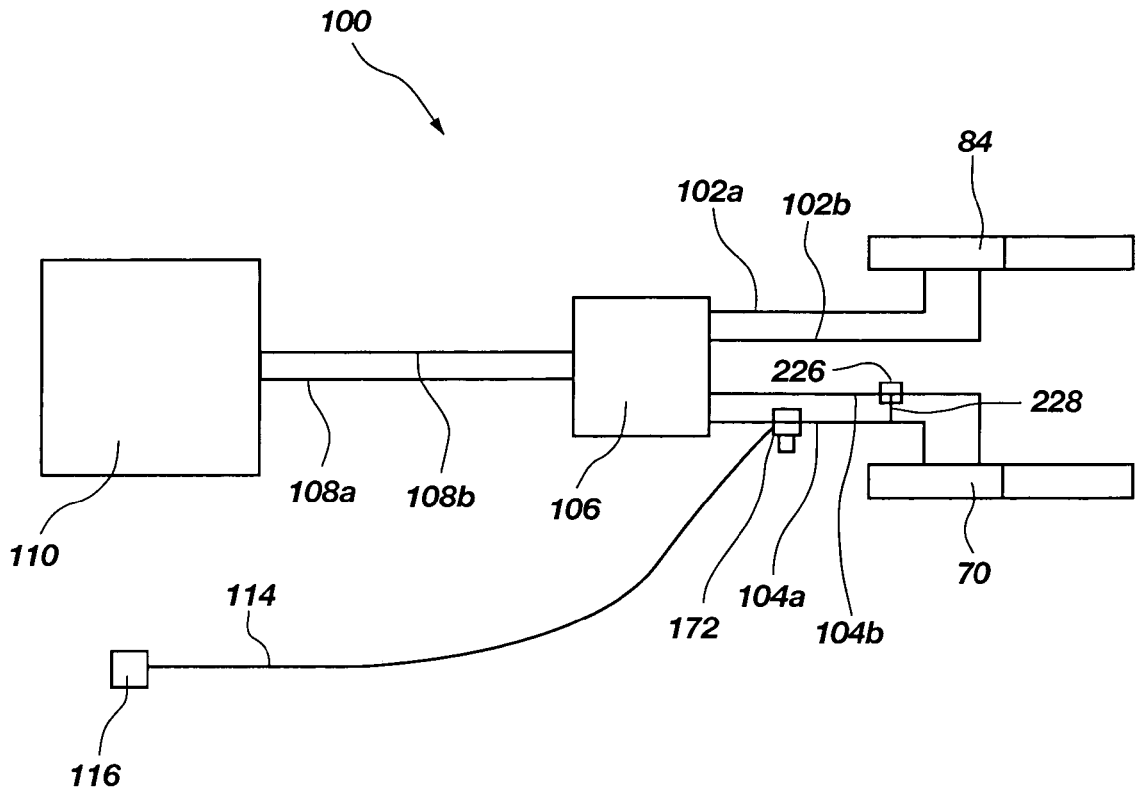
FIG. 6 is a schematic diagram of a hydraulic system used to control the movement of the bucket and the apron of an earth moving apparatus.

Referring now to drawing FIG. 6, there is illustrated a schematic view of the hydraulic system of the present invention generally at 100. As illustrated, the hydraulic system 100 includes the apron hydraulic cylinder 84 and the bucket hydraulic cylinder 70. The apron hydraulic cylinder 84 is operatively connected to a sequence valve 106 through a pair of hydraulic lines 102*a* and 102*b* and the bucket hydraulic cylinder 84 is operatively connected to the sequence valve 106 through a pair of hydraulic lines 104*a* and 104*b* as known in the art. The sequence valve 106 is operatively connected to a hydraulic oil supply 110, such as the hydraulic system of a tractor (not shown), by a pair of hydraulic supply lines 108*a* and 108*b*. In the present invention, the sequence valve 106 is configured such that when hydraulic oil is initiated to flow through the sequence valve 106, the apron hydraulic cylinder 84 fully activates before the bucket hydraulic cylinder 70 is activated.

Although not illustrated, the hydraulic system 100 may also be used to operate the double-acting hydraulic cylinders 44 and 53. For ease of illustration, the portion of the hydraulic system 100 that controls the apron hydraulic cylinder 84 and the bucket hydraulic cylinder 70 are illustrated.

During the dumping process, the hydraulic system 100 of the present invention of the present invention allows the operator of the earth moving apparatus 10 to independently control the raising and lowering of the bucket 16 and the apron 18. To effectuate the independent control of the bucket 16 and the apron 18, an on/off valve 112 is operatively connected to the hydraulic line 104*a* between the sequence valve 106 and the bucket hydraulic cylinder 40. In this manner, the valve 112 may be activated to stop flow of hydraulic oil through the hydraulic lines 104*a* and 104*b* and "lock" the bucket 16 at a certain position. With the valve 112 closed, the pressure of the hydraulic oil will cause the apron hydraulic cylinder 84 to be activated such that the user can control the apron 18 independently of the bucket 16 and with the bucket 16 in a "locked" position.

It will be apparent to those of ordinary skill in the art that any type of valve 112 may be used. In one exemplary embodiment, the valve 112 comprises an electrically controlled valve that is controlled by a control switch 116 that may be located in a cab of the tractor (not shown) used to pull the earth moving apparatus 10 or if the earth moving apparatus is self-propelled, the control switch 116 may be located in the control area of the self-propelled earth moving apparatus. A control wire 114 connects the valve 112 to the control switch 116. In other embodiments, the valve 112 may be any type of valve and controlled in any manner known in the art. Other types of valves that may be used with the hydraulic system 100 of the present invention include, without limitation, sandwich valves, hydraulic control valves, electrohydraulic valves, remote control valves, mobile valves, directional control valves, check valves and manual control valves. Types of control systems that may be used to control the valve 112 of the hydraulic system 100 of the present invention include, without limitation, pressure controlled systems, vacuum systems, manually controlled systems, remote control systems and mechanically linked systems.

Figure 7:
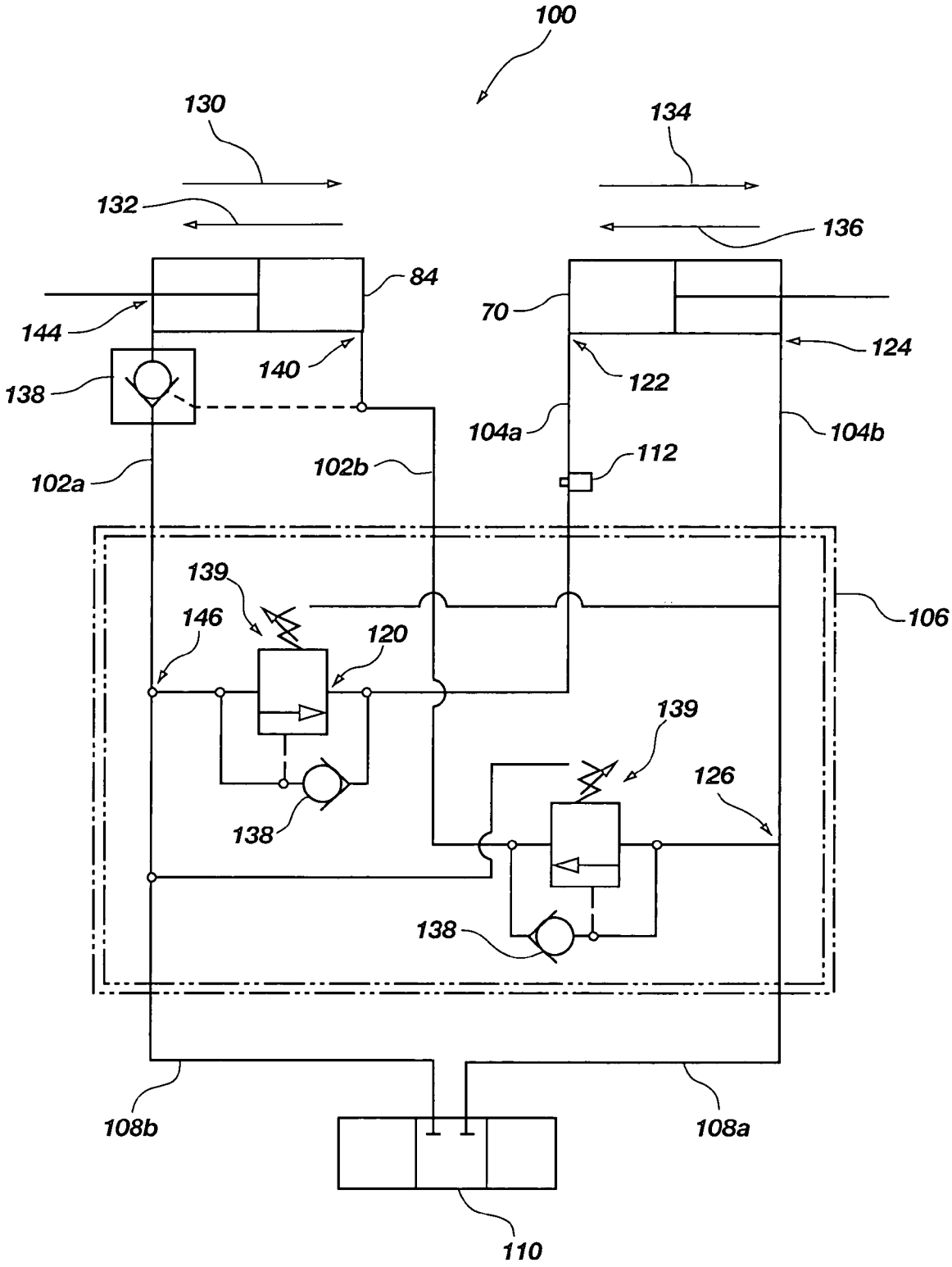
FIG. 7 is more detailed diagram of the hydraulic system of FIG. 6.

Referring now to drawing FIG. 7, there is shown another schematic diagram of the hydraulic system 100 of the present invention. The hydraulic system 100 includes the sequence valve 106, the apron hydraulic cylinder 84, the bucket hydraulic cylinder 70, hydraulic supply lines 108*a* and 108*b*, and hydraulic lines 102*a*, 102*b*, 104*a* and 104*b*. The hydraulic supply lines 108*a* and 108*b* are operatively connected to the hydraulic oil supply 110, such as a hydraulic oil supply of a tractor.

In operation, the operator activates hydraulic oil to flow through the hydraulic system 100 with, e.g., a remote hydraulic control located in the cab of a tractor used to pull the earth moving apparatus, and effectuates hydraulic oil to flow through hydraulic supply line 108*b* and into the sequence valve 106. The sequence valve 106 includes check valves 138 and actuators 139 for controlling the flow of the hydraulic oil as known in the art. From the sequence valve 106, the hydraulic oil flows into the apron hydraulic cylinder 132 and moves the apron hydraulic cylinder 132 in a direction indicated by arrow 130. The hydraulic oil leaves the apron hydraulic cylinder 132 and through hydraulic line 102*b* and to the sequence valve 106. Once the apron hydraulic cylinder 132 has finished moving in the direction indicated by arrow 130, the sequence valve 106 effectuates the hydraulic oil to travel through hydraulic line 104*a* and to the bucket hydraulic cylinder 70, thus effectuating the bucket hydraulic cylinder to move in the direction indicated by arrow 134.

Placement of the valve 112 into the hydraulic system 100 allows the operator of the earth moving apparatus 10 of the present invention to stop the hydraulic oil from flowing through the hydraulic supply lines 104*a* and 104*b* that supply the bucket hydraulic cylinder 70. Although the valve 112 is illustrated as being located at a certain location, the valve 112 may be located at any position in hydraulic supply line 104*a* between arrows 120 and 122 or at any position in hydraulic supply line 104*b* between arrows 124 and 126. When the valve 112 is actuated to the off position, the hydraulic oil ceases to flow through the hydraulic supply lines 104*a* and 104*b* and the flow of hydraulic oil will be effectuated to pass from the sequence valve 106 through the hydraulic supply lines 102*a* and 102*b* and to the apron hydraulic cylinder 84. Movement of the hydraulic oil in this direction effectuates the apron hydraulic cylinder 84 to move in the direction indicated by arrow 132. Thus, placement of the valve 112 into the hydraulic supply line 104*a* or hydraulic supply line 104*b* allows a user to move the bucket 16, close the valve 112 to stop, or "lock," the bucket 16 at a certain height, and effectuate movement of the apron 18 independently of the bucket 16. Further, once the bucket 16 is effectively "locked" at one position by stopping flow of the hydraulic oil to the bucket hydraulic cylinder 70, the user may alternate flow of the hydraulic oil using the tractor remote hydraulic controls to move the apron 18 up and down to further control flow of the soil 82 out of the bucket 16 with the bucket 16 in the "locked" position.

In another exemplary embodiment, the valve 112 (shown in FIG. 6) may be located at a position between arrow 140 and arrow 142 on hydraulic line 102*b* or at a position between arrow 144 and 146 on hydraulic line 102*a*. In this embodiment, closing of the valve 112 would lock the apron 18 into place and allow the user of the earth moving apparatus to raise and lower the bucket 16 with the apron 18 locked in place. In this manner, the user would be able to effectuate the bucket hydraulic cylinder 70 to move in direction 134 or 136 with the apron hydraulic cylinder 84 locked in place.

Figure 8:
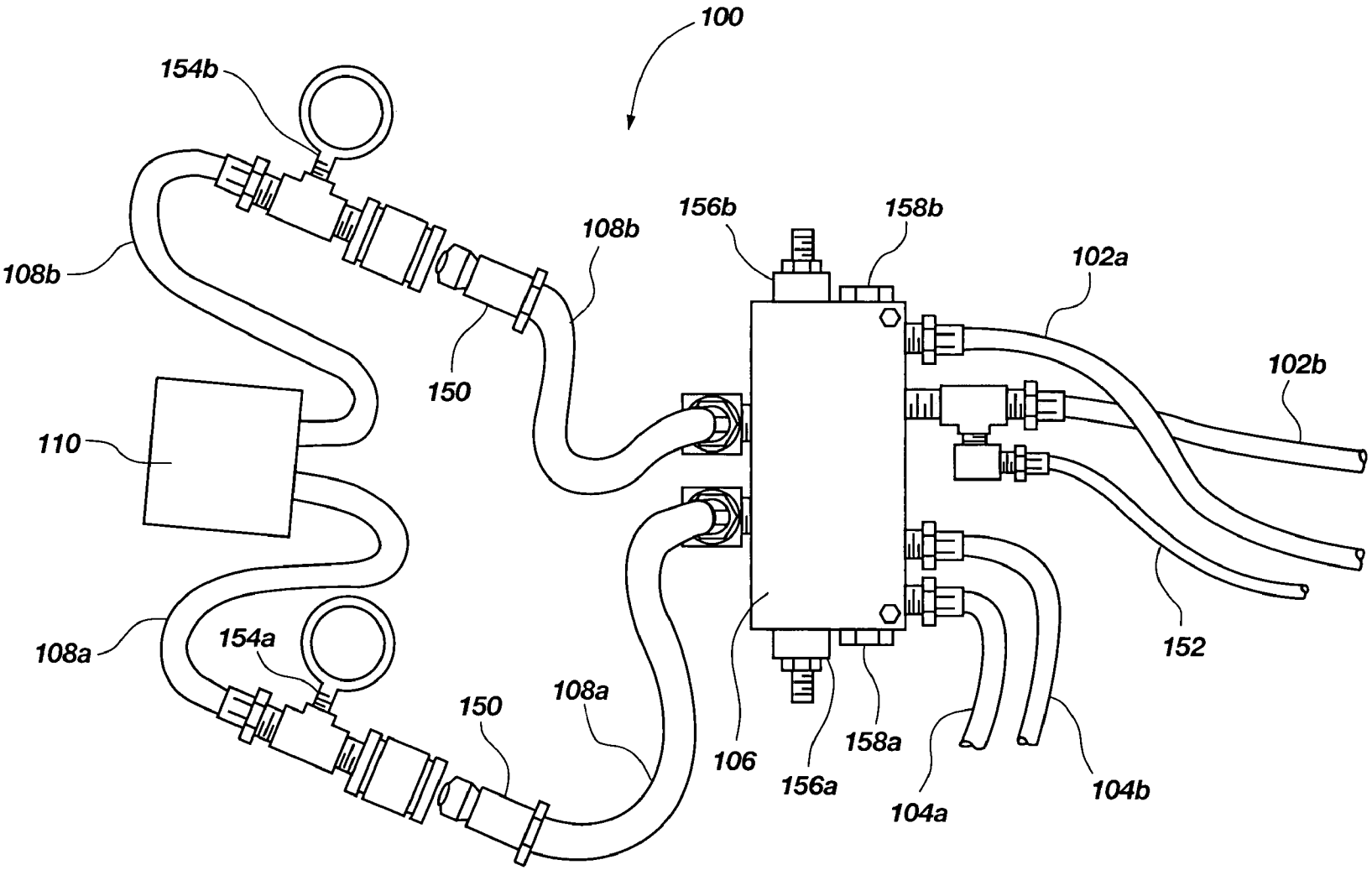
FIG. 8 is one embodiment of the hydraulic system used to control the movement of the bucket and apron on an earth moving or ground leveling apparatus.

Referring now to drawing FIG. 8, there is illustrated one embodiment of the hydraulic system 100 that may be connected to the earth moving apparatus 10 of the present invention. The hydraulic supply lines 108*a* and 108*b* are fitted with couplings 150 which allow the hydraulic system 100 to be operatively connected to the hydraulic oil supply 110, i.e., of a tractor (not shown). It will be apparent by those of ordinary skill in the art that the various connection components and features of the hydraulic system 100 of FIG. 8 are for illustrative purposes and that the various connection components and features may vary without departing from the present invention.

FIG. 8 also illustrates the sequence valve 106 with the hydraulic supply lines 108*a* and 108*b* operatively connected thereto. Hydraulic lines 104*a* and 104*b* are illustrated and are operatively connected to the bucket hydraulic cylinder 70 (FIG. 7) while hydraulic supply lines 102*a* and 102*b* are operatively connected to the apron hydraulic cylinder 84 (FIG. 7). The valve 112 (FIG. 6 or 7) may be positioned anywhere on hydraulic supply lines 104*a* and 104*b*. In an alternative embodiment, the valve 112 may be incorporated in a sequence valve block and located within the sequence valve 106. Also illustrated in FIG. 8 is a line 152 that may be operatively connected to a check valve.

Pilot operated sequence cartridges 156*a* and 156*b* are associated with the sequence valve 106 and are internally piloted. Non-stemmed cartridges 158*a* and 158*b* are also associated with the sequence valve 106. In the illustrated embodiment, once the user of the hydraulic system 100 initiates the apron 18 to open, the sequence valve 106 will effectuate the movement of the hydraulic oil to shift from apron 18 opening to bucket 16 raising at a pressure of about 2000 PSI. Once the bucket 16 is raised, the sequence valve 106 initiates the apron to close at a pressure of about 2000 PSI. These pressures are exemplary and as is known in the art, the pressure may be adjusted such that the pressure required to impart movement to apron 18 and bucket 16 may be varied depending on soil conditions or other factors as determined by the user of the earth moving apparatus 10. Pressure sensors 154*a* and 154*b* may be removably coupled to hydraulic supply lines 108*a* and 108*b*, respectively, for calibrating the sequence valve 106. Following calibration, the pressure sensors 154*a* and 154*b* may be removed for field operations. In another exemplary embodiment, the pressure sensors 154*a* and 154*b* may be omitted from the hydraulic system 100.

Figure 9C:
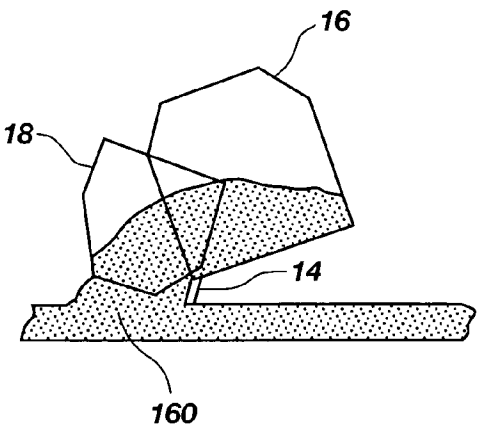
FIGS. 9A, 9B and 9C are side views of the apron in relation to the bucket of the earth moving apparatus of FIG. 1.
Figure 9B:
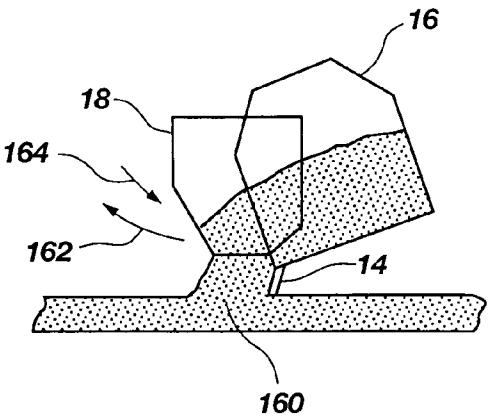
Figure 9A:
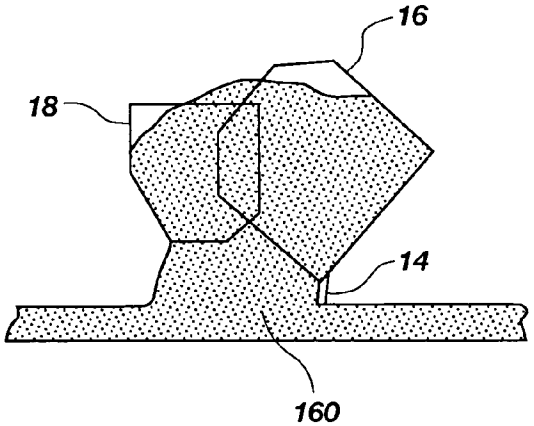

Referring now to drawings FIGS. 9A, 9B and 9C, there is illustrated a side view of the apron 18 and the bucket 16 of the earth moving apparatus 10 of FIG. 1. For ease of illustration, the bucket 16 and apron 18 of the earth moving apparatus 10 are illustrated with other components of the earth moving apparatus 10 omitted. In FIG. 9A, the bucket 16 is shown in a fully raised position and the apron 18 in a fully open position such that soil 160 dumps out of the bucket 16.

FIG. 9B illustrates the bucket 16 in a lower position and the apron 18 in a slightly open position as compared to the earth moving apparatus of FIG. 9A. Using the hydraulic system 100 of the present invention, the operator of the earth moving apparatus 10 is able to control the flow of the soil 160 out of the bucket 16 by moving the apron 18 independently of the bucket 16. For instance, if the operator of the earth moving apparatus determines that not enough soil 160 is exiting the bucket 16 or that the soil 160 is exiting the bucket 16 too slow, the operator can close the switch 112 (FIG. 6 or 7), thus, effectively "locking" the bucket 16 in a stationary position. The operator is then able to open the apron 18 more as illustrated in the direction of arrow 162 or the operator is able to close the apron 18 as illustrated with arrow 164. Thus, the operator is able to control the amount of soil 160 that exits the bucket 16 at a desired rate.

The operator is able to effectuate the movement of the apron 18 using the same hydraulic control, or lever in the tractor used to pull the earth moving apparatus 10, that is used to raise the bucket 16 and the apron 18 in sequence with the sequence valve 106 (FIG. 6). FIG. 9C illustrates the apron 18 opened farther than the apron 18 in relation to the bucket 16 of FIG. 9B such that more soil 160 is emptied from the bucket 16.

Independent control of the apron 18 and the bucket 16 also allows the operator to more efficiently smooth uneven or compacted ground. For instance, the independent movement control of the bucket 16 and the apron 18 allows for the bucket 16 to be locked in a position with the apron 18 opening and closing to break up clods of soil 160, allowing the soil 160 to be spread more thinly. Similarly, the bucket 16 may be locked in an upright position so the operator is able to cut higher ground on one side of the earth moving apparatus 10 with the blade 14 while dumping soil 160 out of the bucket 16 on the other side of the earth moving apparatus 10 to fill in lower ground with the bucket 16 in the upright position.

In another exemplary embodiment, independent control of the bucket 16 and the apron 18 may be achieved by omitting either the hydraulic cylinder 70 that moves the bucket 16 or the hydraulic cylinder 84 that moves the apron 18. In this embodiment, the omitted hydraulic cylinder may be replaced by a separate hydraulic motor and associated hydraulic lines to individually control the movement of the bucket 16 or the apron 18. The omitted hydraulic cylinder may also be replaced by a mechanical device such as a gear box or rack and pinion that can be used to individually control movement of the apron 18 or the bucket 16. In this embodiment, the separate hydraulic motor or the mechanical device could be individually controlled with a switch located in the cab of a tractor used to pull the earth moving apparatus.

Figure 10:
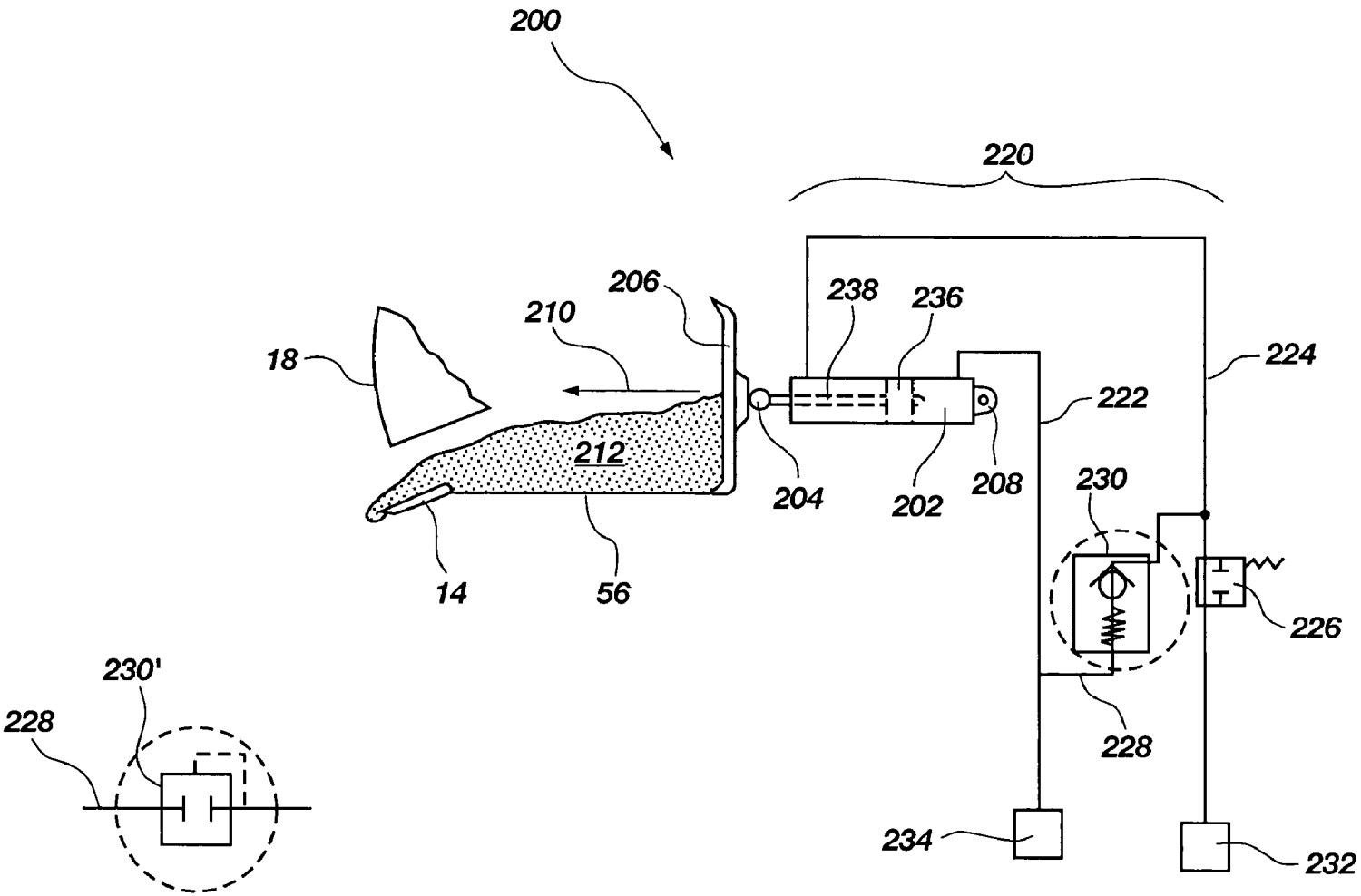
FIG. 10 is a schematic diagram of one embodiment of a hydraulic system used to move an ejector wall in an earth moving apparatus.

Referring now to drawing FIG. 10, there is illustrated another exemplary embodiment of a system used to control the amount of soil removed from an earth moving apparatus generally at 200. Although not illustrated, the system 200 may be operatively connected to an earth moving apparatus, such as the pull-type earth moving apparatus 10 of FIG. 1. Some of the components of the earth moving apparatus have been omitted from FIG. 10 for the ease of illustration. In other exemplary embodiments, the system 200 may be incorporated into a self-propelled type earth moving scraper. When the system 200 is incorporated within the earth moving apparatus 10 of FIG. 1, the upstanding back wall 58 of the earth moving apparatus 10 is replaced with an ejector assembly comprising an ejector cylinder 202, such as a double-acting hydraulic cylinder, and a movable, ejector wall 206 as shown in FIG. 10. A first end 204 of the ejector cylinder 202 is connected to the movable, ejector wall 206 and a second end 208 of the ejector cylinder 202 is connected to a portion of the frame 12 (not shown) opposite the tongue 20 (not shown) of the earth moving apparatus 10 of FIG. 1.

FIG. 10 illustrates the placement of the system 200 associated with the earth moving apparatus 10 of FIG. 1. The ejector wall 206 is positioned in substantially the same position as and replaces the upstanding back wall 58 of FIG. 1. When activated, the ejector cylinder 202 causes the ejector wall 206 to move in a direction indicated by arrow 210 such that soil 212 in the bucket 16 of the earth moving apparatus 10 (FIG. 1) also moves in the direction of the arrow 210. The ejector wall 206 slides across and communicates with the floor 56 such that substantially all of the soil 212 is removed from the floor 56. The soil 212 travels across the floor 56 and passes over the cutting blade 14 as the soil 212 is removed from the earth moving apparatus 10.

In the exemplary embodiment, the ejector cylinder 202 is operatively connected to a hydraulic system indicated with bracket 220. The hydraulic system 220 includes the ejector cylinder 202, an input hydraulic line 222, an output hydraulic line 224, a diversion switch 226, such as a valve, for diverting the flow of hydraulic oil from the output hydraulic line 224 to the input hydraulic line 222, a by-pass line 228 for connecting the input hydraulic line 222 to the output hydraulic line 224, a relief valve 230 for controlling the flow of hydraulic oil, a tank 232 for collecting hydraulic oil and a pump 234 for pumping the hydraulic oil (not shown). In the exemplary embodiment, the tank 232 and the pump 234 are associated with the tractor used to pull the earth moving apparatus. In another exemplary embodiment, the relief valve 230 may be replaced by a valve assembly 230' as illustrated in the inset of FIG. 10. The pressure required to retract the ejector wall 206 with the relief valve 230 or the valve assembly 230' is a low pressure such that the relief valve 230 or the valve assembly 230' can be set at a low pressure.

In another exemplary embodiment as illustrated in FIG. 1, the input hydraulic line 222 may be coupled to a four-way electric solenoid valve 223 or other line switching device. The four-way electric solenoid valve 233 may be switched to apply hydraulic pressure from the input hydraulic pressure line 222 to either hydraulic line 223 or hydraulic line 225. Thus, when the four-way electric solenoid valve 233 couples one of the hydraulic hoses 223 or 225 to the input hydraulic line 222, it automatically couples the other thereof to the output hydraulic line 224, allowing fluid to flow back into the tank 232. It will be appreciated by one of skill in the art that the use of a four-way electric solenoid valve is but one illustration of a way to reverse the action of the hydraulic piston 236 and that additional equipment, apparatus, and/or control systems such as a reversible hydraulic pump could be incorporated into the present invention to accomplish the same.

In operation, when the bucket of the earth moving apparatus fills with soil 212, the system 200 of FIG. 10 is used to remove the soil 212 from the bucket. The operator of the earth moving apparatus activates the hydraulic system 220 using a lever (not shown) associated with tractor as is known in the art. The hydraulic oil flows from the pump 234 through the input hydraulic line 222, the four-way electric solenoid valve 233 when present, on through hydraulic line 223, and into the ejector cylinder 202. The hydraulic oil causes a piston 236 in the ejector cylinder 202 to move in the direction indicated by arrow 210 and, thus, a rod 238 of the ejector cylinder 202 imparts movement to the ejector wall 206 at a "normal" speed. As the load of soil 212 is partially discharged, the ejector wall 206 will move easier since there will be less resistance as some of the soil 212 is discharged and, thus, a smaller amount of pressure of hydraulic oil will be required to move the piston 236.

As the amount of pressure required to move the piston 236 continues to drop, the hydraulic oil flowing from the rod end of the ejector cylinder 202 and through the output hydraulic line 224 will be diverted by the diversion switch 226 once a threshold pressure level is reached. The diversion switch 226 stops the hydraulic oil in the output hydraulic line 224 from flowing to the tank 232 such that the hydraulic oil flows through the by-pass line 228 and into the input hydraulic line 222. In this manner, the hydraulic oil is recycled and increases the volume of hydraulic oil flowing into the ejector cylinder 202 and, thus, the piston 236 will move at a "faster" speed than the "normal" speed. Accordingly, the diversion switch 226 and the by-pass line 228 increase the rate at which the soil 212 is removed from the earth moving apparatus. It will be appreciated that some other line switching device or other apparatus or controls such as a reversible hydraulic pump may be used to reverse the direction of piston 236.

The entire system may be reversed to restore the ejector wall 206 to its starting positing. This may be accomplished by moving the four-way solenoid valve 233 to the position where the hydraulic pressure from the input hydraulic line 222 passes through the four-way electric solenoid valve 233 and hydraulic line 225 into ejector cylinder 202 to reverse the movement of piston 236. It will be appreciated that the reversal of the hydraulic system may be accomplished by other means or apparatus such as a reversible hydraulic pump.

In the exemplary embodiment, the diversion switch 226 comprises a hydraulic pressure sensing switch that is pre-set to divert the flow of hydraulic oil at 1200 PSI, but in other another exemplary embodiment, the diversion switch 226 may comprise a mechanical switch that is activated by the position of the scraper. In yet another exemplary embodiment, the diversion switch 226 may be a manually activated switch that is accessible by the operator of the earth moving apparatus, such as an electric switch, a pneumatic switch, or a hydraulic switch. In another exemplary embodiment, the hydraulic pressure sensing switch may be adjustable such that the amount of pressure required to activate the diversion of hydraulic oil may be varied, such that the pressure can be adjusted to accommodate varying soil types.

In other exemplary embodiments, the diversion switch and by-pass line can be implemented with other hydraulic cylinders of the disclosed earth moving apparatus. Referring in conjunction to FIG. 5 and FIG. 6, the double acting hydraulic cylinder 70 that is implemented to raise the bucket 16 may be configured with a diversion switch and by-pass valve such that the bucket 16 may be raised faster. A by-pass line 228 and a diversion switch 226 may be operatively connected to hydraulic lines 104*a* and 104*b* that are associated with the hydraulic cylinder 70 used to raise and lower the bucket 16. As previously described herein, the diversion switch 226 can be used to effectuate the hydraulic cylinder 70 to operate "faster" once a threshold pressure is reached and the diversion switch 226 diverts hydraulic fluid through the by-pass line 228. In other exemplary embodiments, the diversion switch and by-pass line may be operatively connected to any of the other hydraulic cylinders of the earth moving apparatus.

Figure 11:
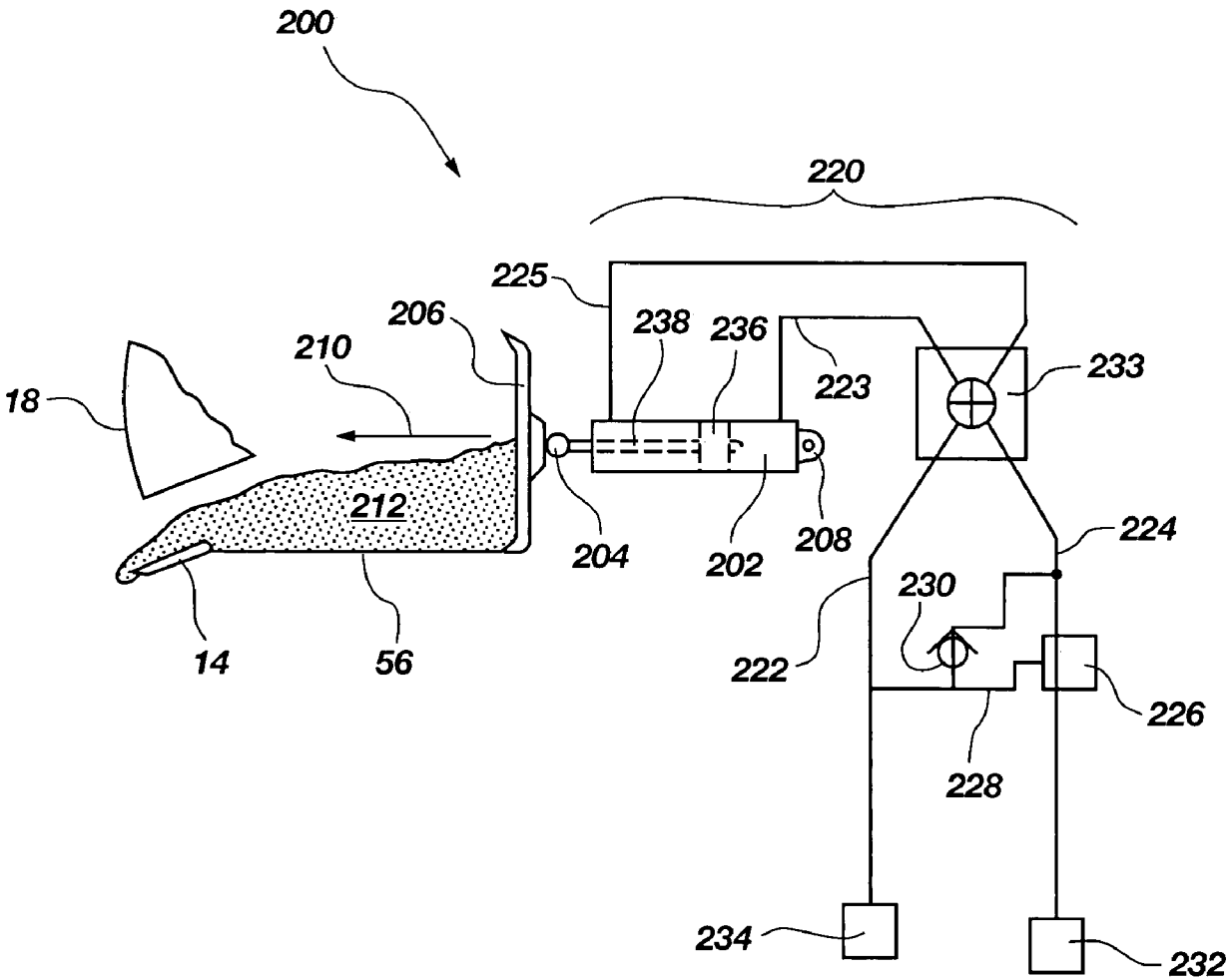
FIG. 11 illustrates another embodiment of the hydraulic system of FIG. 10.

Although the hydraulic systems 220 of FIGS. 10 and 11 have been described as being associated with an earth moving apparatus, the hydraulic system 220 may be implemented in other types of machinery. For instance, the hydraulic system 220 may be implemented in dump trucks, other earth moving machines such as those having booms and dippers, pay loaders, farm equipment, bull dozers, and any other kind of machinery that uses hydraulic systems.

Figure 12:
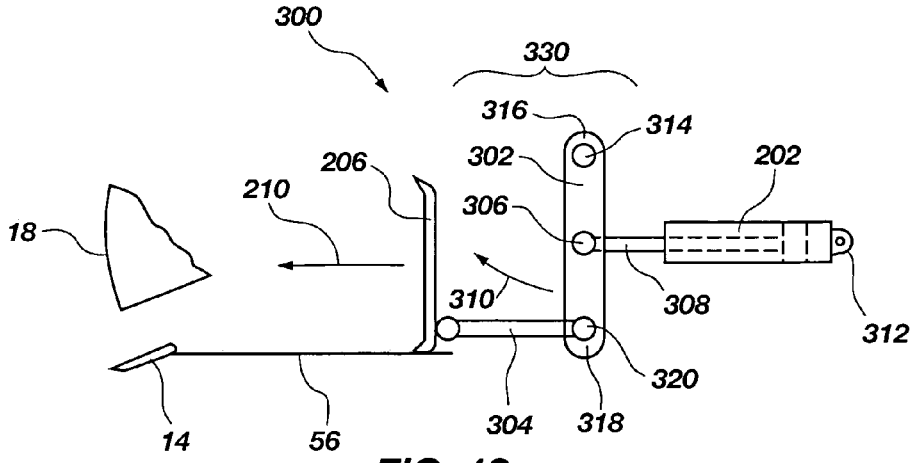
FIG. 12 illustrates one embodiment of a linkage assembly used to move an ejector wall in an earth moving apparatus.

Referring now to FIG. 12, there is illustrated another exemplary embodiment of a system used to control the amount of soil removed from an earth moving apparatus generally at 300. The system 300 may be operatively attached to an earth moving apparatus, such as the pull-type earth moving apparatus 10 of FIG. 1. In another exemplary embodiment, the system 300 may be incorporated in a self-propelled type earth moving scraper. The system 300 includes an ejector cylinder 202, a lever arm 302, a rod 304, and a movable, ejector wall 206.

An end of the rod 306 of the ejector cylinder 202 is pivotably attached to the lever arm 302 such that as a rod 308 of the ejector cylinder 202 is moved in the direction indicated by arrow 210, the lever arm 302 will move in a path as indicated by arrow 310. A second end 312 of the ejector cylinder 202 is attached to a portion of the frame 12 of the earth moving apparatus 10 of FIG. 1. A top end 316 of the lever arm 302 is pivotably attached to a solid member (not shown) of the earth moving apparatus 10 such that the lever arm 302 will travel in the path as illustrated by arrow 310. A bottom end 318 of the lever arm 302 is pivotably attached to the rod 304. The rod 304 is pivotably attached to the ejector wall 206 such that as the lever arm 302 moves in the path as indicated by arrow 310, the rod 304 effectuates the ejector wall 206 to move in the direction indicated by arrow 210.

By attaching the ejector cylinder 202 to the ejector wall 206 through a linkage assembly indicated by bracket 330 including the lever arm 302 and the rod 304, the force required to push the ejector wall 206 and, thus, any soil (not shown) in the direction of arrow 210 is reduced. For instance, as illustrated in FIG. 10, the ejector cylinder 202 exerts force toward the ejector wall 206 in substantially the center portion of the ejector wall 206. As illustrated in FIG. 12, the lever arm 302 lengthens the distance used to create the force on the movable wall 206 and, thus, increases the amount of force applied against the ejector wall 206. Since less force is required to move the ejector wall 206 and the force required to move the ejector wall 206 decreases as the lever arm 302 continues through the path indicated by arrow 310, the ejector cylinder 202 is able to move the ejector wall 206 faster than moving the ejector wall 206 without the linkage assembly 330.

The ejector cylinder 202 of FIG. 12 is operatively connected a hydraulic system (not shown) as known in the art such that an operator of the hydraulic system can effectuate movement of the ejector wall 206. In another exemplary embodiment, the ejector cylinder 202 of FIG. 12 may be operatively connected to the hydraulic system 220 of FIG. 10 such that that the hydraulic cylinder 202 may operate at a "normal" speed and a "faster" speed as described herein with reference to FIG. 10. In a further exemplary embodiment, the "faster" speed of the previous embodiment may be locked out so the hydraulic system 220 of FIG. 10 will only operate at a "normal" speed regardless of the hydraulic pressure sensed by the diversion switch 226 of FIG. 10. The locking out of the "faster" speed may allow for a more controlled dumping and spreading of the soil 212.

Figure 13:
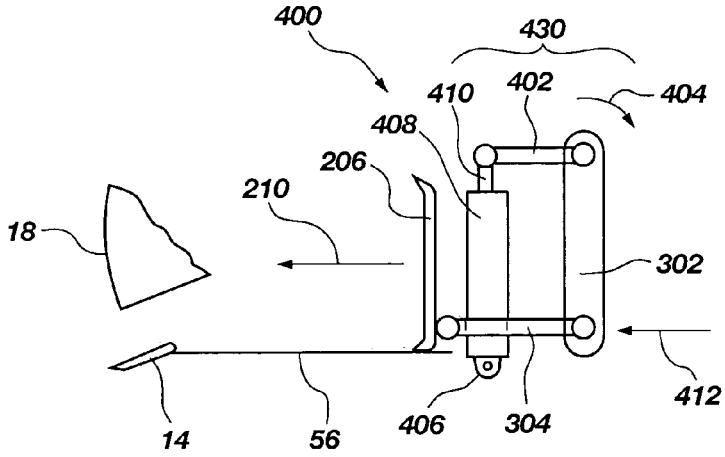
FIG. 13 illustrates another embodiment of a linkage assembly used to move an ejector wall.

Referring to FIG. 13, there is illustrated another exemplary embodiment of a system used to control the amount of soil removed from an earth moving apparatus generally at 400. The system 400 of FIG. 13 is substantially similar to the system 300 of FIG. 12, wherein an ejector cylinder 408 of FIG. 13 has a different orientation than the ejector cylinder 202 of FIG. 12 and is operatively connected to a linkage assembly illustrated generally at bracket 430. The ejector cylinder 202 of FIG. 12 is substantially horizontal, while the ejector cylinder 408 of the system 400 of FIG. 13 is substantially vertical. By orienting the ejector cylinder 408 of FIG. 13 to be substantially vertical, an overall length of the earth moving apparatus having an ejector wall 206 can be shortened.

The system 400 of FIG. 13 may be associated with the earth moving apparatus 10 of FIG. 1, or in another embodiment, may be associated with a self-propelled earth moving scraper. As illustrated in FIG. 13, a rod 410 of the ejector cylinder 408 is pivotably attached to a connecting beam 402 and a second end 406 of the ejector cylinder 408 is fixedly attached to a portion of the earth moving apparatus 10 such that the second end 406 of the ejector cylinder is substantially stationary. As the rod 410 of the ejector cylinder 408 is caused to move in an upward direction by a hydraulic system (not shown), such as the hydraulic system 220 of FIG. 10, the connecting beam 402 will impart a rotational force illustrated by arrow 404 to the lever arm 302. The lever arm 412 will cause the rod 304 to move in a direction indicated by arrow 412 and, thus, effectuate movement of the ejector wall 206 in the direction indicated by arrow 210. It will be apparent by those of ordinary skill in the art that the components illustrated in FIG. 13 are not drawn to scale, but are for exemplary purposes.

Figure 14:
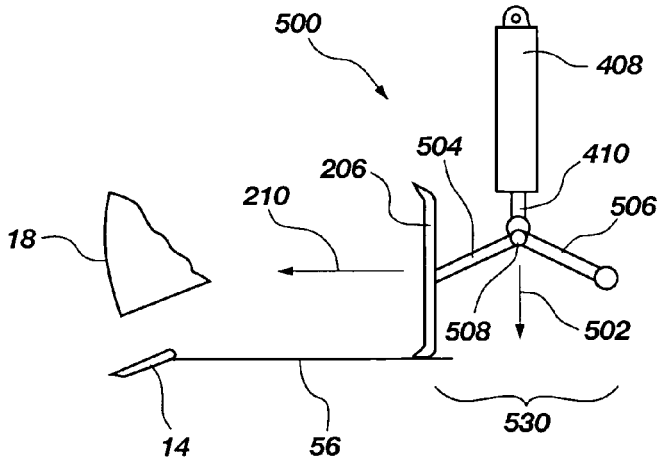
FIG. 14 represents another exemplary embodiment of a linkage assembly used to move the ejector wall.

Another exemplary embodiment of a system used to control the amount of soil removed from an earth moving apparatus is shown generally at 500 in FIG. 14. The system 500 may be associated with the earth moving apparatus 10 of FIG. 1 or with a self-propelled earth moving scraper. The system 500 includes a linkage assembly indicated generally at bracket 530. The linkage assembly 530 includes a scissors type element having a first arm 504 and a second arm 506, wherein the first arm 504 and the second arm 506 are hingedly attached at 508. As the rod 410 of the vertically positioned ejector cylinder 408 moves in the direction indicated by arrow 502, the first arm 504 and the second arm 506 will become substantially horizontal and, thus, effectuate movement of the ejector wall 206 in the direction indicated by arrow 210. Although not illustrated, the ejector cylinder 408 is operatively connected to a hydraulic system, such as the hydraulic system 220 of FIG. 10.

It will be appreciated by those of ordinary skill in the art that the embodiments described herein are not intended to limit the scope of the present invention. Various combinations and modifications of the embodiments described herein may be made without departing from the scope of the present invention and all modifications are meant to be included within the scope of the present invention. Thus, while certain exemplary embodiments and details have been described for purposes of describing the invention, it will be apparent by those of ordinary skill in art that various changes in the invention described herein may be made without departing from the scope of the present invention, which is defined in the appended claims.

What is claimed is:

1. An earth moving or ground leveling apparatus comprising:

a frame having opposing sides;

a cutting blade attached to the frame between the opposing sides;

at least two ground engaging wheels supporting the frame;

a bucket having a floor and a pair of side walls;

an apron for holding soil in the bucket, the apron disposed perpendicular to the pair of sidewalls and disposed across the front of the bucket;

a hydraulic system for imparting movement to the bucket and the apron comprising:

a first valve interconnected in the hydraulic system for controlling movement of the bucket and the apron; and a second valve interconnected in the hydraulic system for preventing movement of the bucket or the apron such that the bucket can be locked in a desired position regardless of a height of the cutting blade.

2. The earth moving or ground leveling apparatus of claim 1, wherein the first valve comprises a sequence valve for sequentially moving the bucket and the apron to one of a soil scraping, retaining or expelling position where the bucket is actuated only alter the apron is fully moved.

3. The earth moving or ground leveling apparatus of claim 1, wherein the second valve is configured to be activated independently from the hydraulic system.

4. The earth moving or ground leveling apparatus of claim 1, further comprising an electronic control means for activating the second valve.

5. The earth moving or ground leveling apparatus of claim 4, further comprising:

a tongue attached to the frame and configured for attachment of the earth moving or ground leveling apparatus to a tractor, wherein the electronic control means is associated with the tractor.

6. The earth moving or ground leveling apparatus of claim 1, wherein the bucket can be locked in a position and the apron can be independently actuated to control the amount of soil entering or leaving the bucket.

7. The earth moving or ground leveling apparatus of claim 1, wherein the hydraulic system further comprises:

a first hydraulic cylinder for moving the bucket;

a second hydraulic cylinder for moving the apron;

at least one first supply line operatively connecting the first valve to the first hydraulic cylinder; and at least one second supply line operatively connecting the first valve to the second hydraulic cylinder.

8. The earth moving or ground leveling apparatus of claim 6, wherein the second valve is operatively connected to the at least one first supply line or the at least one second supply line.

9. A method for controlling movement of a bucket and an apron of an earth moving apparatus, the method comprising:

providing the earth moving apparatus comprising the bucket for storing soil, the apron for holding the soil in the bucket, and a cutting blade for cutting soil to be stored in the bucket;

providing a hydraulic system comprising a first hydraulic cylinder for moving the bucket, a second hydraulic cylinder for moving the apron and a first valve comprising a sequence valve for controlling the movement of the bucket and the apron;

activating the hydraulic system to initiate movement of the bucket and the apron; and, impeding the movement of the bucket or the apron with a second valve, such that the bucket can be locked in a desired position regardless of a height of the cutting blade.

10. The method according to claim 9, wherein impeding the movement of the bucket or the apron comprises activating an electronic means.

11. The method according to claim 9, wherein activation of the hydraulic system causes the bucket and the apron to move in sequence.

12. The method according to claim 9, wherein the impeded movement of the bucket or the apron does not affect the movement of the unimpeded bucket or apron.

13. The method according to claim 9, wherein impeding the movement of the bucket or the apron comprises interrupting a flow of hydraulic fluid to the first hydraulic cylinder or the second hydraulic cylinder.

* * * * *